US005391452A

United States Patent [19]

Sacripante et al.

[11] Patent Number: 5,391,452

[45] Date of Patent: Feb. 21, 1995

[54] POLYESTER TONER AND DEVELOPER COMPOSITIONS

[75] Inventors: Guerino G. Sacripante, Oakville, Canada; Bernard Grushkin, Pittsford, N.Y.; Stephan V. Drappel, Toronto; Allan K. Chen, Oakville, both of Canada

[73] Assignee: Xerox Corporation, Stamford, Conn.

[21] Appl. No.: 100,842

[22] Filed: Aug. 2, 1993

[51] Int. Cl.[6] ..... G03G 9/087

[52] U.S. Cl. ..... 430/106.6; 430/109; 430/904; 430/126

[58] Field of Search ..... 430/109, 904, 126, 106.6; 525/10, 41

[56] References Cited

U.S. PATENT DOCUMENTS

| | | | |
|---|---|---|---|
| 3,590,000 | 6/1971 | Palermiti et al. | 252/62.1 |
| 4,525,445 | 6/1985 | DeRoo et al. | 430/109 |
| 4,533,614 | 8/1985 | Fukumoto et al. | 430/99 |
| 4,940,644 | 7/1990 | Matsubara et al. | 430/109 |
| 4,957,774 | 9/1990 | Doi et al. | 427/45.1 |
| 5,047,305 | 9/1991 | Uchida et al. | 430/110 |

OTHER PUBLICATIONS

*Kirk–Othmer Concise Encyclopedia of Chemical Technology*, John Wiley and Sons, N.Y., pp. 724–725 (1985).

*Primary Examiner*—Christopher D. RoDee

*Attorney, Agent, or Firm*—E. O. Palazzo

[57] ABSTRACT

A toner composition comprised of pigment, an optional charge enhancing additive and a side chain polymer comprised of a polyester present as a side chain on a polyalkylene of the following formula

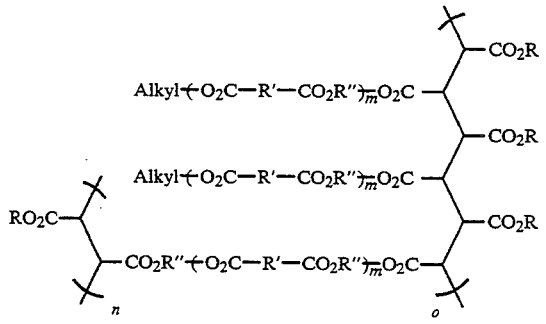

wherein m, n, and o represent the number of monomer segments present; R is independently selected from the group consisting of hydrogen and alkyl; R′ is independently selected from the group consisting of arylene and alkylene; R″ is independently selected from the group consisting of alkylene and oxyalkylene; and wherein m is from about 10 to about 1,000, n is from about 1 to about 1,000 and o is from about 10 to about 1,000.

29 Claims, No Drawings

POLYESTER TONER AND DEVELOPER COMPOSITIONS

BACKGROUND OF THE INVENTION

This invention is generally directed to toner dry and developer compositions, and more specifically, the present invention is directed to developer and toner compositions containing novel side chain polyester resins, and process for the preparation thereof. In embodiments, there are provided in accordance with the present invention toner compositions comprised of certain side chain polyester resin particles, and pigment particles comprised of, for example, carbon black, magnetites, or mixtures thereof, cyan, magenta, yellow, blue, green, red, or brown components, or mixtures thereof thereby providing for the development and generation of black and/or colored images. In embodiments, there are provided in accordance with the present invention a process for the preparation of a side chain polyester by free radical polymerization of endene polyester resins. The toner compositions of the present invention in embodiments possess a number of advantages including low melting characteristics, broad fusing latitude, excellent blocking characteristics, excellent admix characteristics, are of low cost, and possess excellent nonvinyl-offset properties. The toner compositions of the present invention can in embodiments be generated by a process involving (a) the melt polycondensation of about 1 mole equivalent to about 2 mole equivalent of diols such as 1,2-propanediol and diethylene glycol with about 0.9 mole equivalent to about 1 mole equivalent of diacid such as terephthalic acid or diester such as dimethyl terephthalate yielding a polyester oligomer with a low degree of polymerization, such as with a number average molecular weight (Mn) of from about 1,000 to about 10,000 grams per mole, and a weight average molecular weight of from about 2,500 to about 100,000 grams per mole as measured by gel permeation chromatography; (b) followed by the addition of a difunctional unsaturated monomer such as dialkyl maleate or maleic anhydride of from about 0.001 mole equivalent to about 0.1 mole equivalent, thereby enabling the capping or termination of the polyester oligomer, known as an "endene polyester" containing an unsaturated moiety predominantly at the terminal end(s) of the polyester oligomer as illustrated, for example, with reference to the following

OLIGOMERIC ENDENE POLYESTERS $R\text{-}(O_2C\text{-}R'\text{-}CO_2R''\text{-}O_2C)_n\text{-}E$ wherein

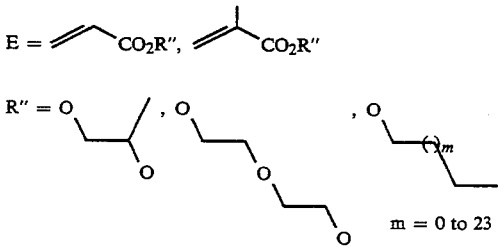

-continued

OLIGOMERIC ENDENE POLYESTERS

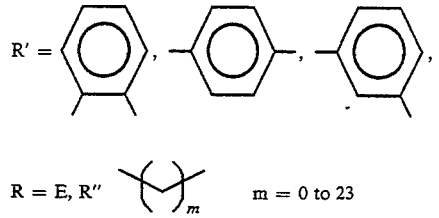

and (c) subsequently followed by the addition of a free radical polymerization initiator such as organic peroxides like benzoyl peroxide, lauryl peroxide or azoisobutyronitrile, and the like, and resulting in the polymerization of the oligomeric endene polyester to provide a side chain polyester resin as illustrated by the following formula

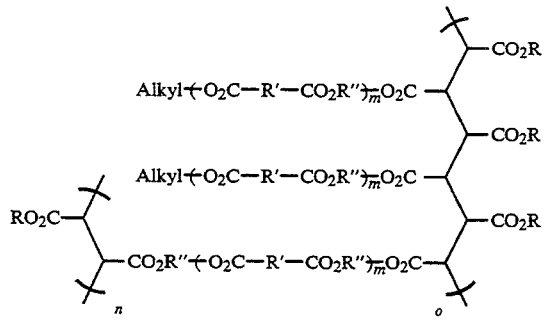

wherein m, n and o represent the number of monomer segments present, R is independently selected from the group consisting of a hydrogen and alkyl, R' is independently selected from the group consisting of arylene and alkylene, R" is independently selected from the group consisting of an alkylene and an oxyalkylene; and with, for example, a number average molecular weight of from about 1,500 to about 50,000 grams per mole as measured by gel permeation chromatography, and a glass transition temperature of from about 40° C. to about 70° C., and more preferably of from about 50° C. to about 64° C. as measured by the Differential Scanning Calorimeter. In embodiments, the side chain polyesters of the present invention can be generated by a process comprising (a) the melt polycondensation of a diol such as 1,2-propanediol and diethylene glycol with a diacid such as terephthalic acid or a diester such as dimethyl-terephthalate and a difunctional unsaturated monomer such as dialkyl maleate yielding directly the endene polyester oligomer with a low degree of polymerization, such as with a number average molecular weight of from about 1,000 to about 6,000 grams per mole as measured by gel permeation chromatography; and (b) subsequently followed by the addition of a free radical polymerization initiator such as benzoyl peroxide and the like, thus resulting in the polymerization of the oligomeric endene polyester to provide a side chain polyester resin with a number average molecular weight of from about 1,500 to about 50,000 grams per mole as measured by gel permeation chromatography, and with a glass transition temperature of from about 40° C. to about 70° C., and more preferably of from about 50° C. to about 64° C. as measured by the Differential Scanning Calorimeter. Alkyl includes components with from 1 to about 25 carbon atoms like methyl, ethyl, propyl, butyl and the like; aryl includes groups with from 6 to about 24 carbon atoms like phenyl, benzyl, halogenated phenyl, and the like; alkylene includes groups with 1 to about 12 carbon atoms like ethylene, propylene, butylene and the like; and oxyalkylene includes groups with 1 to about 12 carbon atoms like oxypropylene, oxyethylene, oxybutylene and the like.

Examples of advantages of the toner composition of the present invention comprised of a side chain polyester include low fusing temperatures, such as from about 120° C. to about 145° C., and therefore, lower fusing energies are required for fixing thus enabling less power consumption during fusing, and permitting extended lifetimes for the fuser system selected. Furthermore, the toner composition of this invention possesses a broad fusing latitude, such as from about 40° C. to about 100° C., with minimal or avoidance of release oil, which inhibits the toner from offsetting onto the fuser rollers usually associated with ghosting or background images on subsequent copies. Furthermore, the fused image obtained from the toner composition of the present invention in embodiments does not substantially offset to vinyl covers, such as those utilized for binders.

In designing polyester resins for toner composition, it is generally required that the glass transition temperature of the resin be from about 50° C. to about 65° C., and preferably no less than about 55° C. so that the toner particles do not aggregate, coalesce or block during manufacturing, transport or storage, or until the toner is required for the fixing step. Additionally, low fusing characteristics are required, hence the polyester resin should melt or flow as low in temperature as possible above the glass transition temperature, such as from about 1° C. to about 40° C. and preferably from about 15° C. to about 35° C., as measured by a capillary rheometer as for instance the Shimadzu CFT-500 Flowtester available from Shimadzu Corporation, which measures the resin's softening point temperature ($T_s$), beginning of flow temperature ($T_1$), and flow temperature ($T_2$) at the manufacturer's standard condition by loading about 1.5 to about 1.8 grams of a pressed resin pellet sample in barrel with a chamber of 4 centimeters in length and 1 centimeter in diameter containing a die at the bottom of the barrel chamber with an orifice opening of 1 millimeter in diameter and 1 millimeter in length, and heating the barrel chamber with a piston loading of 20 Kg/cm$^2$ from an initial temperature of 20° C. to 130° C. at a rate of 10° C. per minute. It is generally observed that polyester resins utilized as low melting toner composition, such as illustrated herein, display a beginning of flow temperature ($T_1$) of from about 80° to about 92° C. Additionally, polyester resins are desired that display broad fusing latitudes of from about 60° C. to about 100° C. This imposes an additional design criteria which avoids or minimizes a drastic drop in melt viscosity or melting too sharply, and which property can also be measured by the Shimadzu flowtester as the flow temperature $T_2$. It is generally regarded that the $T_2$ flow temperature correlates with fusing latitude, and hence in order for the aforementioned low fusing toners to display broad fusing latitude of from about 60° C. to about 100° C., it is necessary in embodiments that the $T_2$ flow temperature should be of from about 15° C. to about 50° C. and preferably be from about 15° C. to about 30° C. higher than the beginning of flow temperature $T_1$. For the prior art linear polyester resins utilized as toner compositions such as those mentioned in U.S. Pat. Nos. 3,590,000; 4,533,614 and illustrated herein Table 3, it is generally observed that these resins display low fusing characteristics of from about 132° C. to about 142° C., and narrow fusing latitude of from about 20° C. to about 35° C., as correlated with the Shimadzu Flowtester which indicates a beginning of flow temperature ($T_1$) of from about 80° C. to about 92° C., and flow temperature ($T_2$) is of from about 5° C. to about 12° C., and thus require high levels of oil to prevent offset to the fuser rollers. With the side chain polyesters of this invention, it is generally observed in embodiments that the beginning of flow temperature ($T_1$) is from about 80° C. to about 92° C., and the flow temperature ($T_2$) is from about 15° C. to about 30° C. higher than $T_1$, and hence display low fusing characteristics, such as from about 135° C. to about 142° C., and accompanied by a broad fusing latitude of from about 50° C. to about 60° C. and higher, which avoids or minimizes the use of fuser or release oils as illustrated in some of the Examples that follow, reference Example XXXII, and in Table 4 herein.

From a research consideration of polyester monomer costs in the 1992 edition of *Chemical Marketing Reporter* (copyright by Schnell Publishing Company), and from research of the glass transition temperature of polyesters in the *Polymer Handbook*, 3rd (by Wiley Interscience), it appears that the least expensive monomers that can be utilized to obtain amorphous polyester resin is poly(diethyleneglycol-terephthalate) with an equilibrium glass transition of 20° C. It is also observed that the poly(1,2-propanediol-terephthalate) resins can be obtained from the next least expensive monomers and display a glass transition of about 85° C. Hence, in a preferred embodiment of the present invention, low cost polyester or oligomers can be obtained from inexpensive monomers, such as 1,2-propanediol, diethylene glycol and terephthalic acid or dimethyl terephthalate, by varying the glycol ratios such that glass transition temperatures of from about 40° C. to about 70° C. can be obtained with number average molecular weight of from about 1,500 to about 20,000 grams per mole useful for toner resin applications. The aforementioned low cost poly(1,2-propylene-diethylene-terephthalate) can also be capped with inexpensive unsaturated monomers, such as maleic anhydride, to provide economical endene polyesters, and further be polymerized with free radical initiators to yield low cost side chain polyesters. To demonstrate the applicability of this low cost polyester system utilizing 1,2-propanediol, diethylene glycol and dimethyl terephthalate, a series of polyester comprised of differing ratios of 1,2-propanediol and diethylene glycol and dimethylterephthalate were prepared as illustrated in Examples I to XVI, and the thermal properties thereof are provided in Table 1. A correlation of glycol ratio and number average molecular weight with the glass transition (Tg) and Shimadzu flow properties ($T_s$, $T_1$, $T_2$) was then obtained, and using a statistical RS/1R software program available from BBN Software Products, the following empirical equations were generated:

$$D=62.2-0.159Tg-1.7T_s-6.17T_1+6.255T_2 \quad \text{Equation (1)}$$

$$M_n=1{,}333T_2 31\,525.2Tg-39{,}300-796T_1+98.7T_s \quad \text{Equation (3)}$$

$$P=100-D$$

wherein

D is the diethylene glycol ratio;

P is the 1,2-propylene glycol ratio;

Mn is the number average molecular weight of the polyester;

Tg is the glass transition temperature of the side chain polyester;

$T_s$ is the softening point of the polyester;

$T_1$ is the beginning of flow temperature of the polyester; and $T_2$ is the flow temperature of the polyester.

Using the above empirical correlation, the glycol ratio of 1,2-propylene to diethylene of the corresponding poly(1,2-propylene-diethylene-terephthalate) resin can be adjusted with its number average molecular weight to match any amorphous linear polyester of specified Tg, and Shimadzu flow properties $T_s$, $T_1$ and $T_2$.

In in U.S. Pat. Nos. 3,590,000 and 4,525,445, there is disclosed a linear polyester comprised preferably of propoxylated bisphenol A and fumaric acid, and available as SPAR II TM from a number of sources, such as Atlas Chemical Company. This polyester resin can be utilized in toner compositions containing a black oxide pigment and can be utilized in the Xerox Corporation 3100 machine equipped with a noncontact fuser, which avoids hot-offset properties, and this is inferior to contact fusing applications as illustrated herein. This linear polyester material displays a glass transition temperature of 54° C. as measured by the DSC, a softening point of 76° C., a beginning of flow temperature of 82° C. and flow temperature ($T_2$) of 98.5° C. as measured by the Shimadzu Flowtester. By substituting these aforementioned values into the above empirical equations 1 and 2, it can be calculated that a linear polyester comprised of poly(1,2-propylene-diethylene-terephthalate) with a glycol ratio of 34.6 to 65.4 of diethylene and propylene glycol, respectively, and of number average molecular weight of 5,852 should display similar thermal properties as the commercially available SPAR II, see Comparative Example XVIII, wherein an economical polyester comprised of (1,2-propylene-diethylene-terephthalate) with a glycol ratio of 34.6 to 65.4 diethylene and propylene glycol, respectively, and of number average molecular weight of 5,700, and which displays a glass transition temperature of 54° C. as measured by the DSC, a softening point of 76° C., a beginning of flow temperature of 82° C. and flow temperature ($T_2$) of 99° C. as measured by the Shimadzu Flowtester. Also note Table 3, wherein the fusing results indicate similar low fusing temperature of about 132° C. and hot-offset of 180° C. for toners comprised of 98 percent by weight of linear polyester and 2 percent by weight of PV FAST BLUE TM pigment. Hence, a linear economical polyester comprised of poly(1,2-propylene-diethylene-terephthalate), estimated from Chemical Marketing Reporter to be of about 30 percent of the cost of SPAR II TM, displays similar fusing performances of SPAR II. In yet another specific example, there is also disclosed in Japanese Patent Laid Open 44836 (1975), 37353 (1982), 109875 (1982) and 3031858-A (1991) and references therein, a linear polyester resin comprised of polybasic carboxylic acid, such as derived from ethoxylated bisphenol A, cyclohexanedimethanol and terephthalic acid. This aforementioned linear polyester material displays a glass transition temperature of 62° C. as measured by the DSC, a softening point of 83° C., a beginning of flow temperature of 91° C. and flow temperature ($T_2$) of 104° C. as measured by the Shimadzu Flowtester. By substituting these aforementioned values into the above empirical equations 1 and 2, it can be calculated that a linear polyester comprised of poly(1,2-propylene-diethylene-terephthalate) with a glycol ratio of 16.6 to 83.4 of diethylene and propylene glycol, respectively, and of number average molecular weight of 2,600 should display similar thermal properties as the commercially available SPAR II TM, see Comparative Example XVII, wherein an economical polyester comprised of (1,2-propylene-diethylene-terephthalate) with a glycol ratio of 16.6 to 83.4 diethylene and propylene glycol respectively, and of number average molecular weight of 3,100 and which displays a glass transition temperature of 62° C. as measured by the DSC, a softening point of 83° C., a beginning of flow temperature of 91° C. and flow temperature ($T_2$) of 104° C. as measured by the Shimadzu Flowtester. Also see Table 3, wherein the fusing results indicate similar low fusing temperature of about 141° C. and hot-offset of 200° C. of toners comprised of 98 percent by weight of linear polyester and 2 percent by weight of PV FAST BLUE TM pigment. Hence, a linear polyester comprised of poly( 1,2-propylene-diethylene-terephthalate) is estimated from Chemical Marketing Reporter to be of about 25 percent of the cost of SPAR II TM. There is also disclosed in U.S. Pat. Nos. 4,533,614 and 4,957,774 a linear polyester resin comprised of dodecylsuccinic anhydride, terephthalic acid, alkyloxylated bisphenol A and trimellitic anhydride as chain extenders. Toner composites thereof display a glass transition temperature of about 56° C. as measured by the DSC, a softening point of 78° C., a beginning of flow temperature of 84° C. and flow temperature ($T_2$) of 98° C. as measured by the Shimadzu Flowtester. By substituting these aforementioned values into the above empirical equations 1 and 2, it can be calculated that a linear polyester comprised of poly(1,2-propylene-diethylene-terephthalate) with a glycol ratio of 18.8 to 81.2 of diethylene and propylene glycol, respectively, and of number average molecular weight of 2,540 should display similar thermal properties as the above polyester resin, see Comparative Example XIX, wherein an economical polyester comprised of (1,2-propylene-diethylene-terephthalate) with a glycol ratio of 18.8 to 81.2 diethylene and propylene glycol, respectively, and of number average molecular weight of 2,610 and which displays a glass transition temperature of 56° C. as measured by the DSC, a softening point of 76° C., a beginning of flow temperature of 84° C. and flow temperature ($T_2$) of 98° C. as measured by the Shimadzu Flowtester. Also see Table 3, wherein the fusing results of the corresponding toners indicate similar low fusing temperature of about 143° C. and 144° C., and hot-offset of 200° C. Hence, a linear economical polyester comprised of poly( 1,2-propylene-diethylene-terephthalate) is estimated from Chemical Marketing Reporter to be of about 20 percent of the cost of the above linear polyester.

There is disclosed in U.S. Pat. Nos. 4,940,644, 5,047,305, 4,049,447, and Canadian Patent 1,032,804, a linear polyester comprised of an amorphous aromatic polyester derived from an arylene radical and diol, and encompasses resins such as poly(neopentyl-terephthalate) comprised of terephthalate radical and neopentyl glycol, see Comparative Example XX, and Table 3 wherein substantially similar results are obtained utilizing the linear polyester comprised of (1,2-propylene-diethylene-terephthalate) with a glycol ratio of 24 to 76 of diethylene glycol and 1,2-propylene glycol, respectively. Also, the linear economical polyester comprised of poly(1,2-propylene-diethylene-terephthalate) estimated from Chemical Marketing Reporter to be of about 80 percent of the cost of the poly(neopentyl-terephthalate) resin. Moreover, in another specific example, utilizing the aforementioned empirical equations, the broadest fusing latitude possible for a linear polyester resin of low fusing temperature of from about 120° C. to about 144° C. can be estimated by the graphical overlap of calculated $T_2$ values by varying both the glass transition temperatures of from about 50° C. to about 65° C., and with softening points of less than 80° C. and beginning of flow temperature ($T_1$) of less than 92° C. In such calculations, it is found that the $T_2$ values of no more than from about 10° C. to about 15° C. higher than $T_1$ can be obtained. Hence, fusing latitudes of from about 50° C. to about 100° C. cannot be attained in toner compositions utilizing these linear amorphous polyesters. With side chain polyesters of this invention, an unsaturated moiety such as maleic anhydride of from about 0.01 to about 0.1 mole equivalents is utilized in preparing an endene polyester comprised of poly(1,2-propylene-diethylene-terephthalate-maleate), followed by its free radical polymerization to yield a side chain polyester as illustrated in Examples XXI to XXVI. The thermal properties of the side chain polyesters are listed in Table 4, and note that the beginning of flow temperature $T_1$ is from about 80° C. to about 92° C. and the flow temperature $T_2$ is approximately 15° to about 30° C., and the fusing latitude is from about 50 to about 60, considerably higher than the above linear polyester. Therefore, the economical side chain polyesters are advantageous in obtaining low fusing toners of from about 130° C. to about 142° C. and accompanied by broad fusing latitude, such as from about 50° to about over 70° C.

Also, there is disclosed in U.S. Pat. No. 4,525,445 a developer composition comprised of a linear polyester derived from fumaric acid, isophthalic acid and propoxylated bisphenol. Further, other toner compositions are known to contain linear polyester resins, such as those disclosed in U.S. Pat. No. 4,968,575, a linear polyester blocked with rosin compound, and U.S. Pat. No. 5,004,664, a linear polyester prepared from the ring opening polymerization of cyclic monomers, and U.S. Pat. No. 5,057,392, a blend of resins comprised of a crystalline and amorphous polyesters; U.S. Pat. Nos. 4,543,313 and 4,891,293 wherein there are disclosed linear thermotropic liquid crystalline polyester resins, the disclosure of which is totally incorporated herein by reference. Other U.S. Patents of interest disclosing linear polyesters are U.S. Pat. Nos. 4,052,325; 3,998,747; 3,909,482; 4,288,516; 4,140,644; 4,489,150; 4,478,423; 4,451,837; 4,446,302; 4,416,965; 4,866,158; 5,153,301; 5,116,713; 5,043,242; 5,045,424; 5,049,646; 5,102,762; 5,110,977 and 4,837,394.

Attempts have been made to overcome the disadvantages of narrow fusing latitude of polyesters such as from about 10° to about 40° C. For instance, developer compositions containing modified polyester resins with a polybasic carboxylic acid are disclosed in Japanese Laid Open Nos. 4836 (1975); 3753 (1982) and 109875 (1982); and also in U.S. Pat. No. 3,681,106; and more specifically branched or crosslinked polyesters derived from polyvalent acids or alcohols are illustrated in U.S. Pat. Nos. 4,298,672; 4,863,825; 4,863,824; 4,845,006; 4,814,249; 4,693,952; 4,657,837; 5,143,809; 5,057,596; 4,988,794; 4,981,939; 4,980,448; 4,960,664; 4,933,252; 4,931,370; 4,917,983 and 4,973,539. The resulting modified polyester resins by branching or crosslinking improve the hot-offset resistance only at a sacrifice of the low fixing temperature performance. Other disadvantages with branched or crosslinked polyesters are high content of gel and inferior unacceptable dispersibility properties with colored pigment for color toner composition, in reduced gloss properties, such as from about 5 to about 40 gloss units as measured by the Gardner Gloss metering unit as reduced transparency efficiency, such as from about 5 to about 60 percent efficiency as measured by the Match Scan II spectrophotometer available from Diano. Moreover, extrusion low melting crosslinked polyesters that can be selected as toner resins and are prepared, for example, from SPAR TM type polyesters are illustrated in copending patent applications U.S. Ser. No. 814,641 and U.S. Pat. No. 5,227,460, the disclosures of which are totally incorporated herein by reference. The aforementioned resins in embodiments have about a 30 percent gel content, and possess a broader fusing latitude than known SPAR TM polyester resins. In the present invention, the second step of reactive extrusion is minimized or avoided. Additionally, the polyesters of this invention differ in that the polyester is a side chain whereas the resin of the U.S. Ser. No. 814,641 is crosslinked resulting from the polymerization of unsaturated moieties through the polyester chain and wherein a high gel content is obtained. The side chain polyester of this invention in embodiments contains no gel, and can be easily dispersed with carbon black or colored pigment and result in high projection efficiency and high gloss. Additionally, the materials cost and process cost of the side chain polyesters of this invention is considerably lower, for example about from about 25 percent to about 50 percent less than the cost of crosslinked SPAR II TM resin.

The following patents are also mentioned: U.S. Pat. Nos. 5,156,937; 4,981,923; 4,990,424; 5,037,715 and 5,147,747, wherein toner compositions are comprised of blends of different polyesters, one of which is characterized with low molecular weight and the other as high molecular weight; and 4,877,704 which discloses a polyester resin of nonlinear copolymer having an aliphatic hydrocarbon group containing 3 to 22 carbon atoms, said copolymer being obtained from polymerization of an etherified bisphenol A monomer, a dicarboxylic acid monomer, and a polyhydric alcohol.

SUMMARY OF THE INVENTION

It is an object of the present invention to provide toner and developer compositions with many of the advantages illustrated herein.

In another object of the present invention there are provided toner compositions with economical polyester resins, and which toners are useful for the development of electrostatic latent images including color images.

In yet another object of the present invention there are provided toner compositions with economical side chain polyesters.

In yet another object of the present invention there are provided processes for the preparation of side chain polyester resins from endene polyester resins.

Another object of the present invention resides in providing toner compositions with economical side chain polyester resins and processes thereof.

Moreover, in another object of the present invention there are provided toner compositions comprised of an economical linear polyester with low melt fusing temperatures of from about 130° C. to about 145° C.

In yet another object of the present invention there are provided processes for the preparation of economical linear polyester resins.

In yet another object of the present invention there are provided processes for the preparation of economical linear endene polyester resins.

In yet a further object of the present invention there is provided a process for toner compositions comprised of an economical linear polyester with a beginning of flow temperature $T_1$ of from about 80° C. to about 92° C. as determined by a Shimadzu flowtester.

In another object of the present invention there are provided toner compositions comprised of an economical linear endene polyester with a beginning of flow temperature $T_1$ of from about 80° C. to about 92° C. as determined from the Shimadzu flowtester.

Moreover, in another object of the present invention there are provided toner compositions comprised of an economical side chain polyester with beginning of flow temperature $T_1$ of from about 80° C. to about 92° C., and flow temperature $T_2$ of from about 15° C. to about 30° C. higher than $T_1$ as measured by the Shimadzu flowtester.

Moreover, in another object of the present invention that are provided toner compositions comprised of an economical side chain polyester with low melt fusing temperatures of from about 130° C. to about 145° C. and broad fusing latitude of from about 30° C. to about 60° C.

Another object of the present invention resides in the formation of toners comprised of side chain polyesters and without the presence of gel.

Another object of the present invention resides in providing empirical equations relating to the thermal properties of an economical linear polyester, such as poly(1,2-propylene-diethylene-terephthalate), by adjusting the 1,2-propylene and diethylene glycol ratio and number average molecular weight together with the glass transition temperature and Shimadzu flow properties $T_s$, $T_1$ and $T_2$.

Yet another object of the present invention resides in providing empirical equations relating to the thermal properties of an economical linear polyester, such as poly(1,2-propylene-diethylene-terephthalate), with thermal properties of other linear amorphous polyesters by adjusting the 1,2-propylene and diethylene glycol ratio and number average molecular weight of the economical polyester with the glass transition temperature and Shimadzu flow properties $T_s$, $T_1$ and $T_2$ as provided by the following expressions $$D=a_1Tg+a_2T_s+a_3T_1+a_4T_2+a_5T_1T_2+a_6T_1T_s+a_7T_2Tg+a_8T_2Tg+a_9T_2T_s$$

$$P=100-DEG$$

$$M_n=b_1Tg+b_2T_s+b_3T_1+b_4T_2+b_5T_1T_2+b_6T_1T_s+b_7T_1Tg+b_8T_2Tg+b_9T_2T_s$$

$$M_w=c_1Tg+c_2T_s+c_3T_1+c_4T_2+c_6T_1T_2+c_6T_1T_s+c_7T_1T_g+c_8T_2Tg+c_9T_2T_s$$

and wherein an, bn and cn are constants, and n is a number of from 1 to about 9, $M_n$ is the number average molecular weight of the polyester, $M_w$ is the weight average molecular weight of the polyester, D is the diethylene glycol ratio.

P is the 1,2-propylene glycol ratio,

Tg is the glass transition temperature of the polyester, $T_s$ is the softening point of the polyester, $T_1$ is the beginning of flow temperature of the polyester, and $T_2$ is the flow temperature of the polyester.

Moreover, in another object of the present invention there are provided toner compositions comprised of a side chain polyester with glass transition temperature of from about 50° C. to about 65° C.

In another object of the present invention there are provided toner compositions comprised of an economical polyester resin with softening point of from about 60° C. to about 82° C. as measured by the Shimadzu Flowtester.

In yet another object of the present invention there are provided toner compositions comprised of an economical side chain polyester resin with number average molecular weight of from about 1,500 grams per mole to about 100,000 grams per mole as measured by GPC.

In yet in another object of the present invention there are provided developer compositions comprised of a toner which displays high projection efficiency on transparency, such as from about 60 to about 99 percent projection using a Match Scan II spectrophotometer available from Diana.

Moreover, it is an object of the present invention to provide a toner which displays high gloss such as from about 30 to about 60 gloss units as measured by the Gardner Gloss metering unit.

Another object of the present invention resides in the formation of toners which will enable the development of images in electrophotographic imaging apparatuses, which images have substantially no background deposits thereon, are substantially smudge proof or smudge resistant, and therefore are of excellent resolution; and further, such toner compositions can be selected for high speed electrophotographic apparatuses, that is those exceeding 70 copies per minute.

Also, in another object of the present invention there are provided developer compositions comprised of toner and carrier particles.

These and other objects of the present invention can be accomplished in embodiments thereof by providing toner compositions comprised of certain polyester resin particles and pigment particles. More specifically, the present invention in embodiment is directed to toner compositions comprised of certain economical side chain polyester resins, pigment, or dye, and optional charge additives.

The polyesters of the present invention are considered side chain polyesters obtained, for example, from the melt esterfication of dimethyl terephthalate, 1,2-propylene glycol, and diethylene glycol to enable oligomeric polyesters; subsequently adding an unsaturated monomer such as dimethyl fumarate, or dimethyl maleate thereby resulting in oligomeric or low molecular weight polyesters capped with an unsaturated moiety; and subsequently polymerizing the obtained polyester preferably by, for example, heating or by other methods, such as extrusion, reference copending patent applications U.S. Ser. No. 814,641, and U.S. Pat. No. 5,227,460 utilizing free radical initiators, such as benzoyl peroxide.

The side chain polyester resins of the present invention are prepared as illustrated herein, and more specifically by generating an endene polyester resin by charging a reactor equipped with a bottom drain valve, double turbine agitator and distillation receiver with a cold water condenser is charged with from about 0.95 to about 1.05 mole of diester, such as dimethylterephthalate, of from about 0.01 to about 0.1 mole of a difunctional unsaturated monomer, such as maleic anhydride or dimethyl maleate, of from about 0.60 to about 2.05 mole of diol such as 1,2-propanediol and from about 0.01 to about 0.40 of a second diol, such as diethylene glycol, and from about 0.001 to about 0.02 mole of catalyst, such as tetrabutyl titanate. The reactor is then heated from about 150° C. to about 187° C. with stirring for a duration of from about 3 hours to about 20 hours, and whereby 0.5 to about 1 mole of alcohol byproduct, such as methanol, is collected in the distillation receiver comprised of from about 90 percent to about 100 percent by volume of methanol and from about 0 percent by volume to about 20 percent by volume of 1,2-propanediol as measured by the ABBE refractometer available from American Optical Corporation. The mixture is then heated at from about 180° to about 210° C., after which the pressure is slowly reduced over from about a 10 minute to about 3 hour period to from about 100 Torr to about 300 Torr, and then reduced to from about 0.01 Torr to about 5 Torr over a period of from about one hour to about 5 hours with a collection of approximately 0.5 to about 2 mole of distillate in the distillation receiver comprised of approximately 90 percent by volume to about 100 percent by volume of 1,2-propanediol and from about 0 percent by volume to about 10 percent by volume of methanol as measured by the ABBE refractometer. The reactor was then purged with nitrogen to atmospheric pressure, and the resulting polymer is comprised of an endene polyester resin such as poly(1,2-propylene-diethylene-terephthalate) terminated with maleate. The reactor temperature is then reduced to from about 120° C. to about 160° C., and there is added a free radical initiator, such as benzoyl peroxide, with stirring for from about 10 minutes to about 3 hours. The resulting side chain polyester resin is then discharged through the bottom drain onto a container cooled with dry ice to yield from about 1.8 to about 2 moles of side chain poly(1,2-propylene-diethylene-terephthalate)-g-maleate resin. The glass transition temperature of the resin can then be measured and is from about 50° to about 65° C. (onset) utilizing the 910 Differential Scanning Calorimeter available from DuPont operating at a heating rate of 10° C. per minute. The number average molecular weight can be measured and is from about 1,500 grams per mole to about 30,000 grams per mole, and the weight average molecular weight was measured to be from about 6,000 grams per mole to about 50,000 grams using tetrahydrofuran as the solvent using the 700 Satelite WISP gel permeation chromatograph available from Waters Company equipped with a styrogel column. About 1.8 grams of the poly(1,2-propylene-diethylene-terephthalate) resin obtained are then pressed into a pellet of about 1 centimeter in diameter and from about 2 to about 3 centimeters in length utilizing the Shimadzu CFT-500 equipped with a die with an orifice opening of 1 millimeter by 1 millimeter in diameter is subjected to a 20 $Kg/cm^2$ load, and heated from 20° C. to 130° C. at a rate of 10° C. per minute. The side chain polyester resin displayed a softening point of from about 70° C. to about 83° C., a beginning of flow temperature $T_1$ of from about 80° C. to about 92° C., and flow temperature $T_2$ of from about 15° C. to about 30° C. higher than $T_1$.

In another embodiment, the side chain polyester resin can be prepared by a process wherein a linear polyester resin is prepared as illustrated herein, followed by capping the linear polyester with an anhydride, such as for instance maleic anhydride, to yield an endene polyester comprised of the aforementioned linear polyester with unsaturated moiety predominantly at the terminal ends, followed by free radical polymerization with an initiator, such as benzoyl peroxide, to result in the formation of economical side chain polyesters with a number of the advantages illustrated herein. More specifically, the linear economical polyester can be obtained by charging a one liter Parr reactor equipped with a bottom drain valve, double turbine agitator and distillation receiver with a cold water condenser with from about 0.95 to about 1.05 mole of diester, such as dimethylterephthalate, from about 0.60 to about 2.05 mole of diol, such as 1,2-propanediol, and from about 0.01 to about 0.40 of a second diol, such as diethylene glycol, and from about 0.001 to about 0.02 mole of catalyst, such as tetrabutyl titanate. The reactor is then heated to from about 150° C. to about 187° C. with stirring for a duration of from about 3 hours to about 20 hours and whereby 0.5 to about 1 mole of alcohol byproduct, such as methanol, is collected in the distillation receiver, comprised of from about 90 percent to about 100 percent by volume of methanol and from about 0 percent by volume to about 20 percent by volume of 1,2-propanediol as measured by the ABBE refractometer available from American Optical Corporation. The mixture is then heated at from about 180° to about 210° C., after which the pressure is slowly reduced over from about a 10 minute to about a 3 hour period to from about 100 Torr to about 300 Torr, and then reduced to from about 0.01 Torr to about 5 Torr over a period of from about one hour to about 5 hours with a collection of approximately 0.5 to about 2 moles of distillate in the distillation receiver comprised of approximately 90 percent by volume to about 100 percent by volume of 1,2-propanediol and from about 0 percent by volume to about 10 percent by volume of methanol as measured by the ABBE refractometer. The reactor was then purged with nitrogen to atmospheric pressure, and the resulting polymer was comprised of a linear polyester resin such as poly(1,2-propylene-diethylene-terephthalate). Thereafter, there is added from about 0.01 to about 0.1 mole of unsaturated monomer, such as maleic anhydride, while maintaining the reactor temperature of from about 120° C. to about 160° C. for a duration of from about 10 minutes to about 3 hours, resulting in an endene polyester comprised of poly(1,2-propylene-diethylene-terephthalate) terminated with maleic acid as the unsaturated monomer, and subsequently followed by adding thereto a free radical initiator such as benzoyl peroxide with stirring while maintaining the reactor temperature of from about 120° C. to about 160° C. for a duration of from about 10 minutes to about 3 hours. The resulting side chain polyester resin is then discharged through the bottom drain onto a container cooled with dry ice to yield from about 1.8 to about 2 moles of side chain poly(1,2-propylene-diethylene-terephthalate)-g-maleate) resin. The reactor was then purged with nitrogen to atmospheric pressure, and the polymer discharged through the bottom drain onto a container cooled with dry ice to yield 410 grams of poly(1,2-propylene-diethylene-terephthalate) resin.

Toners can be obtained by admixing and heating resin particles, such as the side chain poly(1,2-propylene-diethylene-terephthalate-maleate) resin, pigment particles, such as magnetite, carbon black, or mixtures thereof, and preferably from about 0.5 percent to about 5 percent of optional charge enhancing additives, or mixtures of charge additives in a toner extrusion device, such as the ZSK53 available from Werner Pfleiderer, and removing the formed toner composition from the device. Subsequent to cooling, the toner composition is subjected to grinding utilizing, for example, a Sturtevant micronizer for the purpose of achieving toner particles with a volume median diameter of less than about 25 microns, and preferably of from about 8 to about 12 microns, which diameters are determined by a Coulter Counter. Subsequently, the toner compositions can be classified utilizing, for example, a Donaldson Model B classifier for the purpose of removing fines, that is toner particles less than about 4 microns volume median diameter.

Specific examples of the polyester present as the side of the polyesters of the present invention wherein the repeating units m is from about 2 to about 100, and $M_n$ is from about 1,000 grams per mole to about 20,000 grams per mole as measured by the gel permeation chromatography include those selected from the group consisting of polyethylene-terephthalate, polypropylene-terephthalate, polybutylene-terephthalate, polypentylene-terephthalate, polyhexalene-terephthalate, polyheptadene-terephthalate, polyoctalene-terephthalate, polyethylene-sebacate, polypropylene-sebacate, polybutylene-sebacate, polyethylene-adipate, polypropylene-adipate, polybutylene-adipate, polypentylene-adipate, polyhexalene-adipate polyheptadene-adipate, polyoctalene-adipate, polyethylene-glutarate, polypropylene-glutarate, polybutylene-glutarate, polypentylene-glutarate, polyhexalene-glutarate, polyheptadene-glutarate, polyoctalene-glutarate, polyethylene-pimelate, polypropylene-pimelate, polybutylene-pimelate, polypentylene-pimelate, polyhexalene-pimelate, polyheptadene-pimelate, poly(ethylene-diethylene terephthalate), poly( 1,2-propylene-diethylene terephthalate), poly(butylene-diethylene terephthalate), poly(pentylene-diethylene terephthalate), poly(hexylene-diethylene terephthalate), poly(propoxylated bisphenol-succinate), poly(propoxylated bisphenol-adipate), poly(propoxylated bisphenol-glutarate), or mixtures thereof.

Specific examples of endene polyester resins obtained with the processes of the present invention include maleate or fumarate, or itaconate capped or terminated polyesters of polypropylene-terephthalate, polybutylene-terephthalate, polypentylene-terephthalate, polyhexalene-terephthalate, polyheptadene-terephthalate, polyoctalene-terephthalate, polyethylene-sebacate, polypropylene-sebacate, polybutylene-sebacate, polyethylene-adipate, polypropylene-adipate, polybutylene-adipate, polypentylene-adipate, polyhexalene-adipate polyheptadene-adipate, polyoctalene-adipate, polyethylene-glutarate, polypropylene-glutarate, polybutylene-glutarate, polypentylene-glutarate, polyhexalene-glutarate, polyheptadene-glutarate, polyoctalene-glutarate, polyethylene-pimelate, polypropylene-pimelate, polybutylene-pimelate, polypentylene-pimelate, polyhexalene-pimelate, polyheptadene-pimelate, poly(propoxylated bisphenol-succinate), poly(propoxylated bisphenol-adipate), poly(propoxylated bisphenologlutarate), mixtures thereof, and the like; and wherein the terminated unsaturated moiety, such as maleate or fumarate, and employed in effective amounts of, for example, from about 0.01 to about 5 percent by weight of the endene polyester.

Specific examples of diols utilized in preparing the aforementioned polyesters include ethylene glycol, 1,2-propylene glycol, 1,3-propylene glycol, 1,2-butylene glycol, 1,3-butylene glycol, 1,4-butylene glycol, 1,2-pentylene glycol, 1,3-pentylene glycol, 1,4-pentylene glycol, 1,5-pentylene glycol, 1,2-hexylene glycol, 1,3-hexylene glycol, 1,4-hexylene glycol, 1,5-hexylene glycol, 1,6-hexylene glycol, heptylene glycols, octylene glycols, decylyne glycol, dodecylyne glycol, 2,2-dimethyl propanediol, propoxylated bisphenol A, ethoxylated bisphenol A, 1,4-cyclohexane diol, 1,3-cyclohexane diol, 1,2-cyclohexane diol, 1,2-cyclohexane dimethanol, 2-propanediol, mixtures thereof, and the like, and these glycols are employed in various effective amounts of, for example, from about 45 to about 55 mole percent by weight of the resin.

Specific examples of diacids or saturated anhydrides utilized in preparing the aforementioned polyesters include malonic acid, succinic acid, 2-methyl succinic acid, 2,3-dimethyl succinic acid, dodecyl succinic acid, glutaric acid, adipic acid, 2-methyl adipic acid, pimelic acid, azeilic acic, sebacic acid, terephthalic acid, isophthalic acid, phthalic acid, 1,2-cyclohexanedioic acid, 1,3-cyclohexanedioic acid, 1,4-cyclohexanedioic acid, glutaric anhydride, succinic anhydride, dodecyl succinic anhydride, mixtures thereof, which components are selected in effective amounts such as, for example, in amounts of from about 45 to about 55 mole percent by weight of the resin, or polymer.

Specific examples of diesters utilized in preparing the aforementioned side chain polyesters include alkyl esters, wherein the alkyl groups are of 1 carbon chain to about 23 carbon chains and are esters of malonate, succinate, 2-methyl succinate, 2,3-dimethyl succinate, dodecyl succinate, glutarate, adipic acid, 2-methyladipate, pimelate, azeilate, sebacate acid, terephthalate, isophthalate, phthalate, 1,2-cyclohexanedioate, 1,3-cyclohexanedioate, 1,4-cyclohexanedioate, mixtures thereof, and the like; and these diesters are employed in effective amounts of, for example, from about 45 to about 55 mole percent by weight of the resin.

Specific examples of difunctional unsaturated monomers utilized to form the endene polyesters include maleic anhydride, fumaric acid, maleic acid, itaconic acid, 2-methylitaconic acid, diesters of fumarate, maleate, itaconate, and the like, and wherein in the alkyl chain the diester is from 1 to about 23, and the like. These monomers are selected in effective amounts of, for example, from about 0.1 mole percent to about 15 mole percent by weight of the resin.

Specific examples of free radical initiators selected for polymerization include azo-type initiators such as 2-2'-azobis(dimethylvaleronitrile), azobis(isobutyronitrile), azobis(cyclohexane-nitrile), azobis(methylbutyronitrile), mixtures thereof, and the like; peroxide initiators such as benzoyl peroxide, lauroyl peroxide, methyl ethyl ketone peroxide, isopropyl peroxy-carbonate, 2,5-dimethyl-2,5-bis(2-ethylhexanoyl-peroxy)hexane, di-tert-butyl peroxide, cumene hydroperoxide, dichlorobenzoyl peroxide, potassium persulfate, ammonium persulfate, sodium bisulfite, mixtures of potassium persulfate and sodium bisulfite, and mixtures thereof, with the effective quantity of initiator being, for example, selected in effective amounts of, for example, from about 0.1 percent to about 10 percent by weight of that of resin.

Specific examples of polycondensation catalysts can include tetraalkyl titanates, dialkyltin oxide, tetraalkyltin, dialkyltin oxide hydroxide, aluminum alkoxides, alkyl zinc, dialkyl zinc, zinc oxide, stannous oxide, dibutyltin oxide, butyltin oxide hydroxide, tetraalkyl tin such as dibutyltin dilaurate, and mixtures thereof; and they are employed in effective amounts of from about 0.01 mole percent to about 1 mole percent of resin.

Various known colorants present in the toner in an effective amount of, for example, from about 1 to about 25 percent by weight of toner, and preferably in an amount of from about 1 to about 15 weight percent, include carbon black like REGAL 330® magnetites, such as Mobay magnetites MO8029 TM, MO8060 TM; Columbian magnetites; MAPICO BLACKS® and surface treated magnetites; Pfizer magnetites CB4799 TM, CB5300 TM, CB5600 TM, MCX6369 TM; Bayer magnetites BAYFERROX 8600 TM, 8610 TM; Northern Pigments magnetites NP-604 TM, NP-608 TM; Magnox magnetites TMB-100® or TMB-104®; and other equivalent black pigments. As colored pigments there can be selected known cyan, magenta, yellow, red, green, brown, blue or mixtures thereof. Specific examples of pigments include HELIOGEN BLUE L6900 TM, D6840 TM, D7080 TM, D7020 TM, PYLAM OIL BLUE TM and PYLAM OIL YELLOW TM, PIGMENT BLUE 1 TM available from Paul Uhlich & Company, Inc., PIGMENT VIOLET 1 TM, PIGMENT RED 48 TM, LEMON CHROME YELLOW DCC 1026 TM, E.D. TOLUIDINE RED TM and BON RED C TM available from Dominion Color Corporation, Ltd., Toronto, Ontario, NOVAPERM YELLOW FGL TM, HOSTAPERM PINK E TM available from Hoechst, CINQUASIA MAGENTA TM available from E.I. DuPont de Nemours & Company, and the like. Generally, colored pigments that can be selected are cyan, magenta, or yellow pigments, and mixtures thereof. Examples of magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra-(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK®, and cyan components may also be used as pigments with the process of the present invention, and is employed from effective amounts of from about 1 weight percent to about 65 weight percent of the toner.

The toner may also include known charge additives in effective amounts of, for example, from about 0.1 to about 10 weight percent, such as alkyl pyridinium halides, bisulfates, the charge control additives of U.S. Pat. Nos. 3,944,493; 4,007,293; 4,079,014; 4,394,430 and 4,560,635 which illustrates a toner with a distearyl dimethyl ammonium methyl sulfate charge additive, the disclosures of which are totally incorporated herein by reference, mixtures thereof and the like.

Surface additives that can be added to the toner compositions of the present invention include, for example, metal salts, metal salts of fatty acids, colloidal silicas, metal oxides like tin oxide, titanium oxide, mixtures thereof and the like, which additives are usually present in an amount of from about 0.1 to about 1 weight percent, reference U.S. Pat. Nos. 3,590,000; 3,720,617; 3,655,374 and 3,983,045, the disclosures of which are totally incorporated herein by reference. Preferred additives include zinc stearate and AEROSI L R972® available from Degussa.

In another embodiment of the present invention, there are provided, subsequent to known micronization and classification, toner particles with an average diameter of from about 5 to about 20 microns comprised of side chain polyester resin particles, pigment particles, and optional charge enhancing additives.

The polyester resin particles are present in a sufficient, but effective amount, for example from about 70 to about 95 weight percent. Thus, when 1 percent by weight of the charge enhancing additive is present, and about 3 to 10 percent by weight of pigment or colorant, such as carbon black, is contained therein, 96 to about 89 percent by weight of resin is selected. Also, the charge enhancing additive of the present invention may be coated on the pigment particle.

The toner and developer compositions of the present invention may be selected for use in electrostatographic imaging apparatuses containing therein conventional photoreceptors providing that they are capable of being charged negatively. Thus, the toner and developer compositions of the present invention can be used with layered photoreceptors with, for example, metal phthalocyanine, metal free phthalocyanine, vanadyl phthalocyanine, perylenes, chloroindium phthalocyanine, titanyl phthalocyanine and the like as photogenerating pigments that are capable of being charged negatively, such as those described in U.S. Pat. No. 4,265,990, the disclosure of which is totally incorporated herein by reference. Illustrative examples of inorganic photoreceptors that may be selected include selenium; selenium alloys, such as selenium arsenic, selenium tellurium and the like; halogen doped selenium substances; and halogen doped selenium alloys.

The following Examples are being supplied to further define various species of the present invention, it being noted that these Examples are intended to illustrate and not limit the scope of the present invention. Parts and percentages are by weight unless otherwise indicated.

EXAMPLE 1

Poly(1,2-propylene-terephthalate) Resin Derived From 1,2-Propylene glycol and Dimethylterephthalate A one liter Parr reactor equipped with a bottom drain valve, double turbine agitator and distillation receiver with a cold water condenser was charged with 375 grams of dimethylterephthalate, 296.9 grams of 1,2-propanediol (1 mole excess), and 0.8 gram of tetrabutyl titanate as the catalyst. The reactor was then heated to 165° C. with stirring for 16 hours whereby 113 grams of distillate was collected in the distillation receiver comprised of about 98 percent by volume of methanol and 2 percent by volume of 1,2-propanediol as measured by the ABBE refractometer available from American Optical Corporation. The mixture was then heated to 190° C. over a one hour period, after which the pressure was slowly reduced over a one hour period to about 260 Torr, and then reduced to 5 Torr over a two hour period with the collection of approximately 125 grams of distillate in the distillation receiver comprised of approximately 97 percent by volume of 1,2-propanediol and 3 percent by volume of methanol as measured by the ABBE refractometer. The pressure was then further reduced to about 1 Torr over a 30 minute period whereby an additional 15 grams of 1,2-propanediol were collected. The reactor was then purged with nitrogen to atmospheric pressure, and the polymer discharged through the bottom drain onto a container cooled with dry ice to yield 410 grams of poly(1,2-propylene-diethylene-terephthalate) resin. The resin glass transition temperature was then measured to be 65° C. (onset) utilizing the 910 Differential Scanning Calorimeter available from DuPont operating at a heating rate of 10° C. per minute. The number average molecular weight was measured to be 2,200 grams per mole and the weight average molecular weight was measured to be 5,200 grams per mole using tetrahydrofuran as the solvent with the 700 Satelite WISP gel permeation chromatograph available from Waters Company equipped with a styrogel column. 1.8 Grams of this poly(1,2-propylene-diethyleneterephthalate) resin was then pressed into a pellet of about 1 centimeter in diameter and about 10 centimeters in length using the press and die set supplied by Shimadzu with the Flowtester 500 series. The pressed sample pellet was then loaded in the flowtester and subjected to the standard Shimadzu conditions using 20 Kg/cm$^2$, load and barrel temperature heated from 20° C. to 130° C. at a rate of 10° C. per minute. For the resin of this Example, a softening point of 82° C., beginning of flow temperature $T_1$ of 93° C., and flow temperature $T_2$ of 106° C. were obtained.

EXAMPLE II

Poly(1,2-Propylene-terephthalate) Resin With a Diethylene/1,2-Propylene Ratio of 5:95

A one liter Parr reactor equipped with a bottom drain valve, double turbine agitator and distillation receiver with a cold water condenser was charged with 375 grams of dimethylterephthalate, 289.4 grams of 1,2-propanediol (1 mole excess), 10.4 grams of diethylene glycol and 0.8 gram of tetrabutyl titanate as the catalyst. The reactor was then heated to 165° C. with stirring for 16 hours whereby 109 grams of distillate was collected in the distillation receiver comprised of about 98 percent by volume of methanol and 2 percent by volume of 1,2-propanediol as measured by the ABBE refractometer available from American Optical Corporation. The mixture was then heated to 190° C. over a one hour period, after which the pressure was slowly reduced over a one hour period to about 260 Torr, and then reduced to 5 Torr over a two hour period with a collection of approximately 128 grams of distillate in the distillation receiver comprised of approximately 97 percent by volume of 1,2-propanediol and 3 percent by volume of methanol as measured by the ABBE refractometer. The pressure was then further reduced to about 1 Torr over a 30 minute period whereby an additional 16 grams of 1,2-propanediol was collected. The reactor was then purged with nitrogen to atmospheric pressure, and the polymer discharged through the bottom drain onto a container cooled with dry ice to yield 410 grams of poly(1,2 -propylene-diethylene-terephthalate) resin. The resin glass transition temperature was then measured to be 64° C. (onset) utilizing the 910 Differential Scanning Calorimeter available from DuPont operating at a heating rate of 10° C. per minute. The number average molecular weight was measured to be 2,600 grams per mole and the weight average molecular weight was measured to be 6,800 grams per mole using tetrahydrofuran as the solvent and obtained with the 700 Satelite WISP gel permeation chromatograph available from Waters Company equipped with a styrogel column. 1.8 Grams of this poly( 1,2-propylene-diethyleneterephthalate) resin was then pressed into a pellet of about 1 centimeter in diameter and about 10 centimeters in length using the press and die set supplied by Shimadzu with the Flowtester 500 series. The pressed sample pellet was then loaded in the flowtester and subjected to the standard Shimadzu conditions using 20 Kg/cm$^2$, and barrel temperature heated from 20° C. to 130° C. at a rate of 10° C. per minute. For the resin of this Example, a softening point of 80° C., beginning of flow temperature $T_1$ of 93° C., and flow temperature $T_2$ of 106° C. were obtained.

EXAMPLE III

Poly(1,2-Propylene-terephthalate) Resin With a Diethylene/1,2-Propylene Ratio of 10:90

A one liter Parr reactor equipped with a bottom drain valve, double turbine agitator and distillation receiver with a cold water condenser was charged with 375 grams of dimethylterephthalate, 282 grams of 1,2-propanediol (1 mole excess), 20.7 grams of diethylene glycol and 0.8 gram of tetrabutyl titanate as the catalyst. The reactor was then heated to 165° C. with stirring for 16 hours whereby 110 grams of distillate was collected in the distillation receiver comprised of about 98 percent by volume of methanol and 2 percent by volume of 1,2-propanediol as measured by the ABBE refractometer available from American Optical Corporation. The mixture was then heated to 190° C. over a one hour period, after which the pressure was slowly reduced over a one hour period to about 260 Torr, and then reduced to 5 Torr over a two hour period with a collection of approximately 129 grams of distillate in the distillation receiver comprised of approximately 97 percent by volume of 1,2-propanediol and 3 percent by volume of methanol as measured by the ABBE refractometer. The pressure was then further reduced to about 1 Torr over a 30 minute period whereby an additional 17 grams of 1,2-propanediol were collected. The reactor was then purged with nitrogen to atmospheric pressure, and the polymer discharged through the bottom drain onto a container cooled with dry ice to yield 450 grams of poly(1,2-propylene-diethylene-terephthalate) resin. The resin glass transition temperature was then measured to be 63° C. (onset) utilizing the 910 Differential Scanning Calorimeter available from DuPont operating at a heating rate of 10° C. per minute. The number average molecular weight was measured to be 2,900 grams per mole and the weight average molecular weight was measured to be 7,790 grams per mole using tetrahydrofuran as the solvent and obtained with the 700 Satelite WISP gel permeation chromatograph, available from Waters Company, equipped with a styrogel column. 1.8 Grams of this poly(1,2-propylene-diethyleneterephthalate) resin were then pressed into a pellet of about 1 centimeter in diameter and about 10 centimeters in length using the press and die set supplied by Shimadzu with the Flowtester 500 series. The pressed sample pellet was then loaded in the flowtester and subjected to the standard Shimadzu conditions using 20 Kg/cm$^2$, and barrel temperature heated from 20° C. to 130° C. at a rate of 10° C. per minute. For the resin of this Example, a softening point of 80° C., beginning of flow temperature $T_1$ of 92° C., and flow temperature $T_2$ of 106° C. were obtained.

EXAMPLE IV

Poly(1,2-Propylene-terephthalate) Resin With a Diethylene/1,2-Propylene Ratio of 15:85

A one liter Parr reactor equipped with a bottom drain valve, double turbine agitator and distillation receiver with a cold water condenser was charged with 375 grams of dimethylterephthalate, 274.6 grams of 1,2-propanediol (1 mole excess), 31 grams of diethylene glycol and 0.8 gram of tetrabutyl titanate as the catalyst. The reactor was then heated to 165° C. with stirring for 16 hours whereby 115 grams of distillate was collected in the distillation receiver comprised of about 98 percent by volume of methanol and 2 percent by volume of 1,2-propanediol as measured by the ABBE refractometer available from American Optical Corporation. The mixture was then heated to 190° C. over a one hour period, after which the pressure was slowly reduced over a one hour period to about 260 Torr, and then reduced to 5 Torr over a two hour period with a collection of approximately 120 grams of distillate in the distillation receiver comprised of approximately 97 percent by volume of 1,2-propanediol and 3 percent by volume of methanol as measured by the ABBE refractometer. The pressure was then further reduced to about 1 Torr over a 30 minute period whereby an additional 18 grams of 1,2-propanediol was collected. The reactor was then purged with nitrogen to atmospheric pressure, and the polymer discharged through the bottom drain onto a container cooled with dry ice to yield 454 grams of poly(1,2-propylene-diethylene-terephthalate) resin. The resin glass transition temperature was then measured to be 33° C. (onset) utilizing the 910 Differential Scanning Calorimeter available from DuPont operating at a heating rate of 10° C. per minute. The number average molecular weight was measured to be 2,500 grams per mole and the weight average molecular weight was measured to be 3,800 grams per mole using tetrahydrofuran as the solvent and obtained with the 700 Satelite WISP gel permeation chromatograph available from Waters Company equipped with a styrogel column. 1.8 Grams of this poly(1,2-propylene-diethylene-terephthalate) resin were then pressed into a pellet of about 1 centimeter in diameter and about 10 centimeters in length using the press and die set supplied by Shimadzu with the Flowtester 500 series. The pressed sample pellet was then loaded in the flowtester and subjected to the standard Shimadzu conditions using 20 Kg/cm$^2$, and barrel temperature heated from 20° C. to 130° C. at a rate of 10° C. per minute. For the resin of this Example, a softening point of 64° C., beginning of flow temperature $T_1$ of 74° C., and flow temperature $T_2$ of 84° C. were obtained.

EXAMPLES V to XVI

Poly(1,2-propylene-diethylene-terephthalate) resin comprised of 1,2-propylene-diethylene glycol with ratios varying between 15 and 40 was synthesized utilizing the same procedure as Example I with the exception that the 1,2-propylene-diethylene glycol ratio was adjusted accordingly, reference Table 1. The gel permeation, Differential Scanning Calorimeter and Shimadzu Flow properties were then obtained using the same procedure and conditions as illustrated in Example I; and these properties are provided in Table 1.

TABLE 1

Thermal Properties of Examples I to XVI
Poly(1,2-propylene-diethylene-terephthalate) Resin

| EXAMPLE | GLYCOL RATIO | | DSC | GPC | | SHIMADZU (°C.) | | |
|---|---|---|---|---|---|---|---|---|
| | DEG | PPG | ONSET | $M_n$ | $M_w$ | $T_s$ | $T_1$ | $T_2$ |
| I | 0 | 100 | 65.0 | 2.20 | 5.20 | 82 | 93 | 106 |
| II | 5 | 95 | 64.0 | 2.66 | 6.80 | 80 | 93 | 106 |
| III | 10 | 90 | 63.0 | 2.90 | 7.79 | 80 | 92 | 106 |
| IV | 15 | 85 | 33.0 | 2.50 | 3.80 | 64 | 74 | 84 |
| V | 15 | 85 | 61.0 | 5.20 | 8.90 | 78 | 91 | 106 |
| VI | 20 | 80 | 41.0 | 1.30 | 3.70 | 67 | 75 | 86 |
| VII | 20 | 80 | 52.0 | 2.90 | 6.20 | 73 | 84 | 98 |
| VIII | 20 | 80 | 65.0 | 5.50 | 14.0 | 82 | 95 | 110 |
| IX | 25 | 75 | 54.0 | 4.00 | 8.10 | 73 | 84 | 99 |
| X | 30 | 70 | 50.0 | 3.70 | 11.0 | 70 | 80 | 94 |
| XI | 30 | 70 | 57.0 | 5.60 | 17.0 | | | |
| XII | 30 | 70 | 62.5 | 14.00 | 30.0 | 82 | 100 | 118 |
| XIII | 35 | 65 | 49.0 | 3.70 | 8.40 | 71 | 77 | 92 |
| XIV | 35 | 65 | 54.0 | 4.70 | 14.0 | 74 | 84 | 99 |
| XV | 35 | 65 | 60.0 | 10.00 | 22.0 | 78 | 96 | 112 |
| XVI | 40 | 60 | 47.0 | 4.60 | 10.0 | | | |

Diethylene glycol (DEG); 1,2-Propanediol (PPG).

COMPARATIVE EXAMPLE XVII

A toner composition comprised of 98 percent by weight of the linear poly(1,2-propylene-terephthalate) resin with a diethylene/1,2-propylene ratio of 16.6:83.4, and 2 percent by weight of PV FAST BLUE TM pigment was prepared as follows.

A one liter Parr reactor equipped with a bottom drain valve, double turbine agitator and distillation receiver with a cold water condenser was charged with 375 grams of dimethylterephthalate, 272 grams of 1,2-propanediol (1 mole excess), 34.3 grams of diethylene glycol and 0.8 gram of tetrabutyl titanate as the catalyst. The reactor was then heated to 165° C. with stirring for 16 hours whereby 111 grams of distillate was collected in the distillation receiver comprised of about 98 percent by volume of methanol and 2 percent by volume of 1,2-propanediol as measured by the ABBE refractometer available from American Optical Corporation. The mixture was then heated to 190° C. over a one hour period, after which the pressure was slowly reduced over a one hour period to about 260 Torr, and then reduced to 5 Torr over a two hour period with a collection of approximately 124 grams of distillate in the distillation receiver comprised of approximately 97 percent by volume of 1,2-propanediol and 3 percent by volume of methanol as measured by the ABBE refractometer. The pressure was then further reduced to about 1 Torr over a 30 minute period whereby an additional 19 grams of 1,2-propanediol was collected. The reactor was then purged with nitrogen to atmospheric pressure, and the polymer discharged through the bottom drain onto a container cooled with dry ice to yield 410 grams of poly(1,2-propylene-diethylene-terephthalate) resin. The resin glass transition temperature was then measured to be 62° C. (onset) utilizing the 910 Differential Scanning Calorimeter available from DuPont operating at a heating rate of 10° C. per minute. The number average molecular weight was measured to be 3,100 grams per mole and the weight average molecular weight was measured to be 9,300 grams per mole using tetrahydrofuran as the solvent and obtained with the 700 Satelite WISP gel permeation chromatograph available from Waters Company equipped with a styrogel column. About 1.8 grams of this poly(1,2-propylene-diethylene-terephthalate) resin were then pressed into a pellet of about 1 centimeter in diameter and about 10 centimeters in length using the press and die set supplied by Shimadzu with the Flowtester 500 series. The pressed sample pellet was then loaded in the flowtester and subjected to the standard Shimadzu conditions using a 20 Kg/cm$^2$ load, and a barrel temperature heated from 20° C. to 130° C. at a rate of 10° C. per minute. For the resin of this Example, a softening point of 80° C., beginning of flow temperature $T_1$ of 91° C., and flow temperature $T_2$ of 104° C. were obtained.

The above poly(1,2-propylene-diethylene-terephthalate) linear polyester was in the form of a large chunk. The resulting polymer was ground to smaller particles in a Model J Fitzmill equipped with an 850 micrometer screen. After grinding, 392 grams (98 percent by weight of toner) of polymer were mixed with 8 grams of PV FAST BLUE TM pigment (2 percent by weight of toner) available from Hoechst Chemical Corporation. The two components were dry blended first on a paint shaker and then on a roll mill. A small DAVO TM counter rotating twin screw extruder was then used to melt mix the aforementioned mixture. A K-Tron twin screw volumetric feeder was used to feed the mixture to the extruder with a barrel temperature of 120° C., screw rotational speed of 60 rpm at a feed rate of 10 grams per minute. The extruded strands were broken into coarse particles by passing through a Model J Fitzmill twice, the first time with an 850 micrometer screen, and the second time with a 425 micrometer screen. An 8 inch Sturtevant micronizer was used to reduce the particle size further. After grinding, the toner was measured to display an average volume diameter particle size of 7.5 microns with a geometric distribution of 1.38 as measured by the Coulter Counter. For the toner of this Example, a softening point of 83° C., beginning of flow temperature $T_1$ of 91° C., and flow temperature $T_2$ of 104° C. were obtained as measured by the Shimadzu Flowtester. A developer composition was prepared by roll milling the aforementioned toner, 3 parts by weight with 100 parts by weight of carrier comprised of a steel core with polyvinylidene polymer coating thereof. The Tribo data was obtained using the known blow-off Faraday Cage apparatus, and the charge was measured to be 12.7 microcoulombs per gram. Unfused copies were then produced using a Xerox Corporation 1075 imaging apparatus with the fusing system disabled. The unfused copies were then subsequently fused on a customized test fuser using a process speed of 11.9 inches per second. Fusing evaluation of the toner indicated a minimum fixing temperature of about 141° C., and hot-offset temperature of about 200° C.

COMPARATIVE EXAMPLE XVIII

A toner composition comprised of 98 percent by weight of the linear poly(1,2-propylene-terephthalate) resin with a diethylene/1,2-propylene ratio of 34.6:65.4, and 2 percent by weight of PV FAST BLUE TM pigment was prepared as follows.

In a one liter Parr reactor equipped with a bottom drain valve, double turbine agitator and distillation receiver with a cold water condenser were charged with 375 grams of dimethylterephthalate, 245 grams of 1,2-propanediol (1 mole excess), 71.6 grams of diethylene glycol and 0.8 gram of tetrabutyl titanate as the catalyst. The reactor was then heated to 165° C. with stirring for 16 hours whereby 106 grams of distillate was collected in the distillation receiver comprised of about 97.5 percent by volume of methanol and 2.5 percent by volume of 1,2-propanediol as measured by the ABBE refractometer available from American Optical Corporation. The mixture was then heated to 190° C. over a one hour period, after which the pressure was slowly reduced over a one hour period to about 260 Torr, and then reduced to 5 Torr over a two hour period with a collection of approximately 129 grams of distillate in the distillation receiver comprised of approximately 97 percent by volume of 1,2-propanediol and 3 percent by volume of methanol as measured by the ABBE refractometer. The pressure was then further reduced to about 1 Torr over a 30 minute period whereby an additional 17 grams of 1,2-propanediol were collected. The reactor was then purged with nitrogen to atmospheric pressure, and the polymer discharged through the bottom drain onto a container cooled with dry ice to yield 444 grams of poly(1,2-propylene-diethylene-terephthalate) resin. The resin glass transition temperature was then measured to be 54° C. (onset) utilizing the 910 Differential Scanning Calorimeter available from DuPont operating at a heating rate of 10° C. per minute. The resin number average molecular weight was measured to be 5,700 grams per mole and the weight average molecular weight was measured to be 11,100 grams per mole using tetrahydrofuran as the solvent and obtained with the 700 Satelite WISP gel permeation chromatograph, available from Waters Company, equipped with a styrogel column. About 1.8 grams of this poly(1,2-propylene-diethylene-terephthalate) resin were then pressed into a pellet of about 1 centimeter in diameter and about 10 centimeters in length using the press and die set supplied by Shimadzu with the Flowtester 500 series. The pressed sample pellet was then loaded in the flowtester and subjected to the standard Shimadzu conditions using 20 Kg/cm$^2$ load, and barrel temperature heated from 20° C. to 130° C. at a rate of 10° C. per minute. For the resin of this Example, a softening point of 76° C., beginning of flow temperature $T_1$ of 82° C., and flow temperature $T_2$ of 99° C. were obtained.

The resulting polymer was then fabricated into a cyan toner comprised of 98 percent of polyester and 2 percent by weight of PV FAST BLUE TM using the same procedure as in Example XVII. After grinding, the toner was measured to display an average volume diameter particle size of 7.0 microns with a geometric distribution of 1.35 as measured by the Coulter Counter. The resulting toner was then utilized without further classification. For the toner of this Example, a softening point of 83° C., beginning of flow temperature $T_1$ of 91° C., and flow temperature $T_2$ of 104° C. were obtained as measured by the Shimadzu Flowtester. A developer composition was prepared by roll milling the aforementioned toner, 3 parts by weight with 100 parts by weight of carrier comprised of a steel core with continuous polyvinylidene polymer coating thereof, 1.75 weight percent. The tribo data was obtained using the known blow-off Faraday Cage apparatus, and the charge was measured to be 22.7 microcoulombs per gram. Unfused copies were then produced using a Xerox Corporation 1075 imaging apparatus with the fusing system disabled. The unfused copies were then subsequently fused on a customized Barcelona fuser using a process speed of 11.9 inches per second. Fusing evaluation of the toner indicated a minimum fixing temperature of about 132° C., and hot-offset temperature of about 180° C.

COMPARATIVE EXAMPLE XIX

A toner composition comprised of 98 percent by weight of the linear poly(1,2-propylene-terephthalate) resin with a diethylene/1,2-propylene ratio of 18.8:81.2, and 2 percent by weight of PV FAST BLUE TM pigment was prepared as follows.

A one liter Parr reactor equipped with a bottom drain valve, double turbine agitator and distillation receiver with a cold water condenser was charged with 375 grams of dimethylterephthalate, 268.9 grams of 1,2-propanediol (1 mole excess), 38.9 grams of diethylene glycol and 0.8 gram of tetrabutyl titanate as the catalyst. The reactor was then heated to 165° C. with stirring for 16 hours whereby 115 grams of distillate was collected in the distillation receiver comprised of about 98 percent by volume of methanol and 2 percent by volume of 1,2-propanediol as measured by the ABBE refractometer available from American Optical Corporation. The mixture was then heated to 190° C. over a one hour period, after which the pressure was slowly reduced over a one hour period to about 260 Torr, and then reduced to 5 Torr over a two hour period with collection of approximately 126 grams of distillate in the distillation receiver comprised of approximately 97 percent by volume of 1,2-propanediol and 3 percent by volume of methanol as measured by the ABBE refractometer. The pressure was then further reduced to about 1 Torr over a 30 minute period whereby an additional 14 grams of 1,2-propanediol was collected. The reactor was then purged with nitrogen to atmospheric pressure, and the polymer discharged through the bottom drain onto a container cooled with dry ice to yield 460 grams of poly(1,2-propylene-diethylene-terephthalate) resin. The resin glass transition temperature was then measured to be 56° C. (onset) utilizing the 910 Differential Scanning Calorimeter available from DuPont operating at a heating rate of 10° C. per minute. The number average molecular weight was measured to be 2,610 grams per mole and the weight average molecular weight was measured to be 6,800 grams per mole using tetrahydrofuran as the solvent and obtained with the 700 Satelite WISP gel permeation chromatograph available from Waters Company equipped with a styrogel column. 1.8 Grams of this poly(1,2-propylene-diethylene-terephthalate) resin was then pressed into a pellet of about 1 centimeter in diameter and about 10 centimeters in length using the press and die set supplied by Shimadzu with the Flowtester 500 series. The pressed sample pellet was then loaded in the flowtester and subjected to the standard Shimadzu conditions using 20 Kg/cm$^2$ load, and barrel temperature heated from 20° C. to 130° C. at a rate of 10° C. per minute. For the resin of this example, a softening point of 76° C., beginning of flow temperature $T_1$ of 84° C., and flow temperature $T_2$ of 98° C. were obtained.

The resulting polymer was then fabricated into a cyan toner comprised of 98 percent of polyester and 2 percent by weight of PV FAST BLUE® using the same procedure as in Example XVII. After grinding, the toner was measured to display an average volume diameter particle size of 6.5 microns with a geometric distribution of 1.39 as measured by the Coulter Counter. The resulting toner was then utilized without further classification. For the toner of this Example, a softening point of 76° C., beginning of flow temperature $T_1$ of 84° C., and flow temperature $T_2$ of 98° C. were obtained as measured by the Shimadzu Flowtester. A developer composition was prepared by roll milling the aforementioned toner, 3 parts by weight with 100 parts by weight of carrier comprised of a steel core with polyvinylidene polymer coating (continuous and about 1.75 weight percent throughout unless otherwise noted) thereof. The Tribo data was obtained using the known blow-off Faraday Cage apparatus, and the charge was measured to be 18 microcoulombs per gram. Unfused copies were then produced using a Xerox Corporation 1075 imaging apparatus with the fusing system disabled. The unfused copies were then subsequently fused on a test fuser using a process speed of 11.9 inches per second. Fusing evaluation of the toner indicated a minimum fixing temperature of about 143° C., and hot-offset temperature of about 190° C.

COMPARATIVE EXAMPLE XX

A toner composition comprised of 98 percent by weight of the linear poly(1,2-propylene-terephthalate) resin with a diethylene/1,2 -propylene ratio of 24:76, and 2 percent by weight of PV FAST BLUE TM pigment was prepared as follows.

To a one liter Parr reactor equipped with a bottom drain valve, double turbine agitator and distillation receiver with a cold water condenser was charged 375 grams of dimethylterephthalate, 261.2 grams of 1,2-propanediol (1 mole excess), 49.7 grams of diethylene glycol and 0.8 gram of tetrabutyl titanate as the catalyst. The reactor was then heated to 165° C. with stirring for 16 hours whereby 109 grams of distillate was collected in the distillation receiver comprised of about 98 percent by volume of methanol and 2 percent by volume of 1,2-propanediol as measured by the ABBE refractometer available from American Optical Corporation. The mixture was then heated to 190° C. over a one hour period, after which the pressure was slowly reduced over a one hour period to about 260 Torr, and then reduced to 5 Torr over a two hour period with collection of approximately 129 grams of distillate in the distillation receiver comprised of approximately 97 percent by volume of 1,2-propanediol and 3 percent by volume of methanol as measured by the ABBE refractometer. The pressure was then further reduced to about 1 Torr over a 30 minute period whereby an additional 14 grams of 1,2-propanediol were collected. The reactor was then purged with nitrogen to atmospheric pressure, and the polymer discharged through the bottom drain onto a container cooled with dry ice to yield 465 grams of poly(1,2-propylene-diethylene-terephthalate) resin. The resin glass transition temperature was then measured to be 53° C. (onset) utilizing the 910 Differential Scanning Calorimeter available from DuPont operating at a heating rate of 10° C. per minute. The number average molecular weight was measured to be 2,200 grams per mole and the weight average molecular weight was measured to be 6,800 grams per mole using tetrahydrofuran as the solvent and obtained with the 700 Satelite WISP gel permeation chromatograph available from Waters Company equipped with a styrogel column. 1.8 Grams of this poly(1,2-propylene-diethylene-terephthalate) resin was then pressed into a pellet of about 1 centimeter in diameter and about 10 centimeters in length using the press and die set supplied by Shimadzu with the Flowtester 500 series. The pressed sample pellet was then loaded in the flow tester and subjected to the standard Shimadzu conditions using 20 Kg/cm$^2$ load, and barrel temperature heated from 20° C. to 130° C. at a rate of 10° C. per minute. For the resin of this Example, a softening point of 73° C., beginning of flow temperature $T_1$ of 81° C., and flow temperature $T_2$ of 95° C. were obtained.

The resulting polymer was then fabricated into a cyan toner comprised of 98 percent of polyester and 2 percent by weight of PV FAST BLUE TM, using the same procedure as in Example XVII. After grinding, the toner was measured to display an average volume diameter particle size of 5.6 microns with a geometric distribution of 1.41 as measured by the Coulter Counter. The resulting toner was then utilized without further classification. A developer composition was prepared by roll milling the aforementioned toner, 3 parts by weight with 100 parts by weight of carrier comprised of a steel core with polyvinylidene polymer coating thereof. For the toner of this Example, a softening point of 73° C., beginning of flow temperature $T_1$ of 81° C., and flow temperature $T_2$ of 95° C. were obtained as measured by the Shimadzu Flowtester. The tribo data was obtained using the known blow-off Faraday Cage apparatus, and the charge was measured to be 26 microcoulombs per gram. Unfused copies were then produced using a Xerox Corporation 1075 imaging apparatus with the fusing system disabled. The unfused copies were then subsequently fused on a test fuser (throughout VITON ® coated fuser rolls with both rolls heated and an aminomethyl amino siloxane release oil) using a process speed of 11.9 inches per second. Fusing evaluation of the toner indicated a minimum fixing temperature of about 138° C., and hot-offset temperature of about 190° C.

EXAMPLE XXI

A one liter Parr reactor equipped with a bottom drain valve, double turbine agitator and distillation receiver with a cold water condenser was charged with 375 grams of dimethylterephthalate, 252.3 grams of 1,2-propanediol (1 mole excess), 62.1 grams of diethylene glycol and 0.8 gram of tetrabutyl titanate as the catalyst. The reactor was then heated to 165° C. with stirring for 16 hours whereby 105 grams of distillate were collected in the distillation receiver comprised of about 98 percent by volume of methanol and 2 percent by volume of 1,2-propanediol as measured by the ABBE refractometer available from American Optical Corporation. The mixture was then heated to 190° C. over a one hour period, after which the pressure was slowly reduced over a one hour period to about 260 Torr, and then reduced to 5 Torr over a two hour period with a collection of approximately 110 grams of distillate in the distillation receiver comprised of approximately 97 percent by volume of 1,2-propanediol and 3 percent by volume of methanol as measured by the ABBE refractometer. The pressure was then further reduced to about 1 Torr over a 30 minute period whereby an additional 15 grams of 1,2-propanediol were collected. The reactor was then purged with nitrogen to atmospheric pressure, and the reactor temperature was reduced to 130° C., and added thereto 9.6 grams of maleic anhydride (2.5 mole percent of polymer) with stirring. After 30 minutes of stirring, benzoylperoxide (1.0 gram) was added, and the mixture stirred for an additional three hours and causing the formation of the side chain polyester. The product was then discharged at 170° C. through the bottom drain onto a container cooled with dry ice to yield 410 grams of poly(1,2-propylene-diethylene-terephthalate)-g-maleate resin. The resin glass transition temperature was then measured to be 35° C. (onset) utilizing the 910 Differential Scanning Calorimeter available from DuPont operating at a heating rate of 10° C. per minute. The number average molecular weight was measured to be 2,700 grams per mole and the weight average molecular weight was measured to be 7,000 grams per mole using tetrahydrofuran as the solvent and obtained with the 700 Satelite WISP gel permeation chromatograph available from Waters Company equipped with a styrogel column. 1.8 Grams of this poly(1,2-propylene-diethylene-terephthalate) resin were then pressed into a pellet of about 1 centimeter in diameter and about 10 centimeters in length using the press and die set supplied by Shimadzu with the Flowtester 500 series. The pressed sample pellet was then loaded in the flowtester and subjected to the standard Shimadzu conditions using a 20 Kg/cm$^2$ load, and a barrel temperature heated from 20° C. to 130° C. at a rate of 10° C. per minute. For the resin of this Example, a softening point of 60° C., beginning of flow temperature $T_1$ of 72° C., and flow temperature $T_2$ of 86° C. were obtained.

EXAMPLE XXII

A side chain polyester was prepared by repeating the process of Example XXI.

EXAMPLES XXIII to XXXI

Side chain polyester resins comprised of poly-(1,2-propylene-terephthalate)-g-maleate with varying ratios of diethylene/1,2-propylene and with varying amounts of maleic anhydride, see Table 2, were prepared by repeating the procedure of Example XXII.

TABLE 2

Thermal Properties of Examples XXII to XXXI
Side Chain Poly(1,2-propylene-diethylene-terephthalate) Resin

| EXAMPLE | DEG/ PPG | MA (mole %) | Tg | GPC $10^3$ g/mole $M_n$ | $M_w$ | SHIMADZU (°C.) $T_s$ | $T_{f1}$ | $T_{f2}$ |
|---|---|---|---|---|---|---|---|---|
| XXII | 30/70 | 2.5 | 35 | 2.5 | 7.2 | 60 | 72 | 86 |
| XXIII | 15/85 | 2.5 | 55 | 3.5 | 10.0 | 79 | 91 | 115 |
| XXIV | 15/85 | 5.0 | 47 | 3.4 | 9.9 | 76 | 89 | 115 |
| XXV | 15/85 | 7.5 | 54 | 3.9 | 13.2 | 80 | 89 | 114 |
| XXVI | 15/85 | 10.0 | 57 | 4.1 | 16.8 | 80 | 89 | 110 |
| XXVII | 0/100 | 2.5 | 53 | 4.0 | 14.2 | 74 | 85 | 101 |
| XXVIII | 0/100 | 5.0 | 59 | 4.2 | 15.9 | 79 | 92 | 117 |
| XXIX | 5/95 | 2.5 | 51 | 3.8 | 10.6 | 72 | 86 | 109 |
| XXX | 10/90 | 2.5 | 51 | 3.8 | 10.9 | 72 | 81 | 106 |
| XXXI | 10/90 | 5.0 | 58 | 4.0 | 17.1 | 80 | 90 | 118 |

MA = Maleic Anhydride

EXAMPLE XXXII

A toner composition comprised of 98 percent by weight of the side chain poly(1,2-propylene-terephthalate) resin of Example XXIII, and 2 percent by weight of PV FAST BLUE TM was prepared by the procedure of Example XVII. After grinding, the toner was measured to display an average volume diameter particle size of 8.6 microns with a geometric distribution of 1.35 as measured by the Coulter Counter. The resulting toner was then utilized without further classification. A developer composition was prepared by roll milling the aforementioned toner, 3 parts by weight, with 100 parts by weight of carrier comprised of a steel core with polyvinylidene polymer coating thereof. The tribo data was obtained using the known blow-off Faraday Cage apparatus, and the charge was measured to be 16 microcoulombs per gram. Unfused copies were then produced using a Xerox Corporation 1075 imaging apparatus with the fusing system disabled. The unfused copies were then subsequently fused on a customized test using a process speed of 11.9 inches per second. Fusing evaluation of the toner indicated a minimum fixing temperature of about 142° C., and no hot-offset temperature was observed at the highest fusing temperature tested of 210° C. For the toner of this Example, a softening point of 79° C., beginning of flow temperature $T_1$ of 91° C., and flow temperature $T_2$ of 115° C. were obtained as measured by the Shimadzu Flowtester 500.

EXAMPLE XXXIII

A toner composition comprised of 98 percent by weight of the side chain poly(1,2-propyleneoterephthalate) resin of Example XXV, and 2 percent by weight of PV FAST BLUE TM pigment was prepared by the procedure of Example XVII. After grinding, the toner was measured to display an average volume diameter particle size of 8.0 microns with a geometric distribution of 1.36 as measured by the Coulter Counter. The resulting toner was then utilized without further classification. A developer composition was prepared by roll milling the aforementioned toner, 3 parts by weight, with 100 parts by weight of carrier comprised of a steel core with polyvinylidene polymer coating thereof. The tribo data was obtained using the known blow-off Faraday Cage apparatus, and the charge was measured to be 19 microcoulombs per gram. Unfused copies were then produced using a Xerox Corporation 1075 imaging apparatus with the fusing system disabled. The unfused copies were then subsequently fused on a test fuser using a process speed of 11.9 inches per second. Fusing evaluation of the toner indicated a minimum fixing temperature of about 138° C., and no hot-offset temperature was observed at the highest fusing temperature tested of 210° C. For the toner of this Example, a softening point of 76° C., beginning of flow temperature $T_1$ of 89° C., and flow temperature $T_2$ of 116° C. were obtained as measured by the Shimadzu Flowtester 500.

EXAMPLE XXXIV

A toner composition comprised of 98 percent by weight of the side chain poly(1,2-propylene-terephthalate) resin of Example XXVI, and 2 percent by weight of PV FAST BLUE TM pigment was prepared by the procedure of Example XVII. After grinding, the toner was measured to display an average volume diameter particle size of 7.0 microns with a geometric distribution of 1.35 as measured by the Coulter Counter. The resulting toner was then utilized without further classification. A developer composition was prepared by roll milling the aforementioned toner, 3 parts by weight, with 100 parts by weight of carrier comprised of a steel core with polyvinylidene polymer coating thereof. The tribo data was obtained using the known blow-off Faraday Cage apparatus, and the charge was measured to be 21 microcoulombs per gram. Unfused copies were then produced using a Xerox Corporation 1075 imaging apparatus with the fusing system disabled. The unfused copies were then subsequently fused on a test fuser using a process speed of 11.9 inches per second. Fusing evaluation of the toner indicated a minimum fixing temperature of about 136° C., and no hot-offset temperature was observed at the highest fusing temperature tested of 210° C. For the toner of this Example, a softening point of 80° C., beginning of flow temperature $T_1$ of 89° C., and flow temperature $T_2$ of 114° C. were obtained as measured by the Shimadzu Flowtester 500.

EXAMPLE XXXV

A toner composition comprised of 98 percent by weight of the side chain poly(1,2-propylene-terephthalate) resin of Example XXVII, and 2 percent by weight of PV FAST BLUE TM pigment was prepared by the procedure of Example XVII. After grinding, the toner was measured to display an average volume diameter particle size of 7.2 microns with a geometric distribution of 1.35 as measured by the Coulter Counter. The resulting toner was then utilized without further classification. A developer composition was prepared by roll milling the aforementioned toner, 3 parts by weight, with 100 parts by weight of carrier comprised of a steel core with polyvinylidene polymer coating thereof. The tribo data was obtained using the known blow-off Faraday Cage apparatus, and the charge was measured to be 19 microcoulombs per gram. Unfused copies were then produced using a Xerox Corporation 1075 imaging apparatus with the fusing system disabled. The unfused copies were then subsequently fused on a test fuser using a process speed of 11.9 inches per second. Fusing evaluation of the toner indicated a minimum fixing temperature of about 137° C., and no hot-offset temperature was observed at the highest fusing temperature tested of 210° C. For the toner of this Example, a softening point of 80° C., beginning of flow temperature $T_1$ of 89° C., and flow temperature $T_2$ of 110° C. were obtained as measured by the Shimadzu Flowtester 500.

TABLE 3

| | Toner Compositions Comprised of Linear Polyester and 2 Percent By Weight of PV FAST BLUE TM | | | | | | | |
|---|---|---|---|---|---|---|---|---|
| COMPARATIVE | CALCULATED GLYCOL RATIO | | Number Average Molecular Weight $10^3$ g/mole Calculated/ | SHIMADZU (°C.) | | | FUSING (°C.) | |
| EXAMPLE | DEG | PPG | Observed | $T_s$ | $T_{f1}$ | $T_{f2}$ | MFT | HT |
| XVII | 16.6 | 83.4 | 2.60/3.1 | 83 | 91 | 104 | 141 | 200 |
| FE208 | — | — | — | 83 | 91 | 104 | 142 | 200 |
| XVIIII | 34.6 | 65.4 | 5.85/5.7 | 76 | 82 | 99 | 132 | 180 |
| SPAR II | — | — | — | 74 | 82 | 98.5 | 132 | 180 |
| XIX | 18.8 | 81.2 | 2.54/2.61 | 76 | 84 | 98 | 143 | 200 |

TABLE 3-continued

| Toner Compositions Comprised of Linear Polyester and 2 Percent By Weight of PV FAST BLUE TM | | | | | | | | |
|---|---|---|---|---|---|---|---|---|
| COMPARATIVE EXAMPLE | CALCULATED GLYCOL RATIO DEG | PPG | Number Average Molecular Weight $10^3$ g/mole Calculated/ Observed | SHIMADZU (°C.) $T_s$ | $T_{f1}$ | $T_{f2}$ | FUSING (°C.) MFT | HT |
| CLC-500 | — | — | — | 78 | 84 | 98 | 144 | 200 |
| XX | 24.0 | 76.0 | 2.13/2.2 | 73 | 81 | 95 | 135 | 180 |
| Poly(neopentyl-terephthalate) | — | — | — | 73 | 81 | 95 | 137 | 180 |

Minimum Fusing Temperature (MFT);
Hot-Offset (HT)

TABLE 4

| Toner Compositions Comprised of Side Chain Polyester and 2 Percent by Weight of PV FAST BLUE TM | | | | | |
|---|---|---|---|---|---|
| EXAMPLE | SHIMADZU (°C.) $T_s$ | $T_1$ | $T_2$ | FUSING (°C.) MFT | HT |
| XXXII | 79 | 91 | 115 | 142 | >210 |
| XXXIIII | 76 | 89 | 116 | 138 | >210 |
| XXXIV | 80 | 89 | 114 | 136 | >210 |
| XXXV | 80 | 89 | 110 | 137 | >210 |

Minimum Fusing Temperature (MFT);
Hot-Offset (HT)

Other embodiments and modifications of the present invention may occur to those skilled in the art subsequent to a review of the information presented herein; these embodiments and modifications, as well as equivalents thereof, are also included within the scope of this invention.

What is claimed is:

1. A dry toner composition comprised of pigment, an optional charge enhancing additive and a side chain polymer comprised of a polyester present as a side chain on a polyalkylene of the following formula

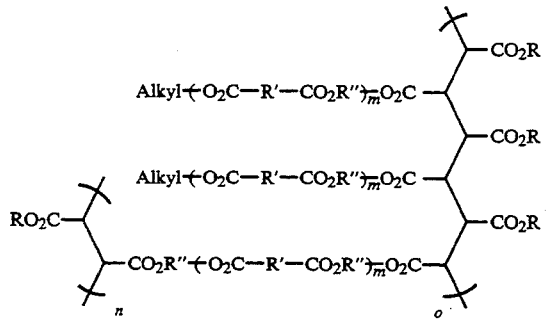

wherein m, n, and o represent the number of monomer segments present; R is independently selected from the group consisting of hydrogen and alkyl; R' is independently selected from the group consisting of arylene and alkylene; R'' is alkylene with from 2 to 12 carbon atoms; and wherein m is from about 10 to about 1,000, n is from about 1 to about 1,000 and o is from about 10 to about 1,000.

2. A toner composition in accordance with claim 1 which possesses a low fixing temperature of from about 130° C. to about 145° C., and a broad fusing latitude of from about 40° C. to about 120° C.

3. A toner composition in accordance with claim 1 wherein R is alkyl with from 1 to about 20 carbon atoms.

4. A toner composition in accordance with claim 3 wherein R is methyl, ethyl, propyl, butyl, pentyl, hexyl, heptyl, octyl, nonyl, decyl, undecyl, dodecyl, stearyl, or lauryl.

5. A toner composition in accordance with claim 3 wherein the pigment particles are carbon black, magnetites, or mixtures thereof, cyan, magenta, yellow, red, blue, green, brown, or mixtures thereof present in an amount of from about 1 to about 20 weight percent.

6. A toner composition in accordance with claim 1 wherein R' is selected from the group consisting of phenylene, terephthalylene, isophthalylene, phthalylene, xylylene, 1,4-cyclohexylene, 1,3-cyclohexylene, 1,2-cyclohexylene, 1,4-naphthylene, 1,7-naphthylene, 1,6-naphthylene, 1,3 naphthylene, 1,2-naphthylene, 1,8-naphthylene, biphenylene, methylene, ethylene, propylene, butylene, pentylene, hexylene, heptylene, octylene, nonylene, decylene, undecylene, dodecylene, stearylene, and laurylene.

7. A toner composition in accordance with claim 6 wherein the side chain polyester resin is obtained from an endene polyester predominantly terminated with an unsaturated monomer, terminated polyesters of polyethylene-terephthalate, polypropylene-terephthalate, polybutylene-terephthalate, polypentylene-terephthalate, polyhexalene-terephthalate, polyheptadene-terephthalate, polyoctalene-terephthalate, polyethylene-sebacate, polypropylene-sebacate, polybutylene-sebacate, polyethylene-adipate, polypropylene-adipate, polybutylene-adipate, polypentylene-adipate, polyhexalene-adipate polyheptadene-adipate, polyoctalene-adipate, polyethylene-glutarate, polypropylene-glutarate, polybutylene-glutarate, polypentylene-glutarate, polyhexalene-glutarate, polyheptadene-glutarate, polyoctalene-glutarate, polyethylene-pimelate, polypropylene-pimelate, polybutylene-pimelate, polypentylene-pimelate, polyhexalene-pimelate, polyheptadene-pimelate, or mixtures thereof.

8. A toner composition in accordance with claim 1 wherein R'' is ethylene, propylene, butylene, pentylene, hexylene, heptylene, octylene, nonylene, decylene, undecylene, dodecylene, neopentylene, 1,2-propylene, 1,2-butylene, 2-pentylene, or 2,2-dimethylpropylene.

9. A toner composition in accordance with claim 1 wherein m is a number of from about 10 to about 100, n is a number of from about 1 to about 100, and o is a number of from about 10 to about 100.

10. A toner composition in accordance with claim 1 wherein the main chain polyalkylene resin is selected from the group consisting of polymaleate, polyfumarate, polyitaconate, polystyrene-maleate, polyacrylate-maleate, polymethacrylate-maleate, polystyrene-fumarate, and polystyrene-itaconate.

11. A toner composition in accordance with claim 1 wherein said side chain polyester m has an $M_n$ of from about 1,500 to about 20,000, and an $M_w$ of from about 2,500 to about 100,000.

12. A toner composition in accordance with claim 1 wherein the polyester m present as the side chain is selected from the group consisting of poly(1,2-propylene-diethylene)-g-maleate, poly(1,2-propylene-diethylene)-g-fumarate, poly(1,2-propylene-diethylene)-g-itaconate, poly(1,3-propylene-diethylene)-g-maleate, poly(1,3-propylene-diethylene)-g-fumarate, poly(1,3-propylene-diethylene)-g-itaconate, poly(butylene-diethylene)-g-maleate, poly(butyl-diethylene)-g-fumarate, poly(1,3-butyl-diethylene)-gitaconate, poly(1,2-propylene-1,3-butylene)-g-maleate, poly(1,2-propylene-1,3-butylene)-g-fumarate, poly(1,2-propylene-1,3-butylene)-g-itaconate, and mixtures thereof.

13. A toner composition in accordance with claim 1 wherein the side chain polyester is poly(1,2-propylene-diethylene)-g-maleate or poly(1,2-propylene-diethylene)-g-fumarate.

14. A toner composition in accordance with claim 1 wherein the polyester is obtained from the reaction of dimethyl terephthalate, 1,2-propylene glycol, and diethylene glycol; thereafter reacting the formed oligomeric polyester with a difunctional unsaturated monomer; followed by polymerization thereof.

15. A toner composition in accordance with claim 1 wherein the glass transition temperature thereof is from about 50° C. to about 65° C.

16. A toner composition in accordance with claim 1 with a softening temperature of from about 70° C. to about 84° C.

17. A toner composition in accordance with claim 1 wherein the initial flow temperature ($T_1$) thereof is from about 80° C. to about 95° C.

18. A toner composition in accordance with claim 1 wherein the flow temperature ($T_2$) thereof is from about 15° C. to about 30° C. higher than the initial flow temperature ($T_1$).

19. A toner composition in accordance with claim 1 wherein the minimum fixing temperature thereof is from about 130° C. to about 145° C., and the fusing latitude is from about 60° C. to about 120° C.

20. A toner composition in accordance with claim 1 wherein a charge enhancing additive is incorporated into the toner, or is present on the surface of the toner.

21. A toner composition in accordance with claim 1 further containing as external additives metal salts of a fatty acid, colloidal silicas, or mixtures thereof.

22. A toner composition in accordance with claim 1 wherein the pigment particles are carbon black, magnetites, or mixtures thereof, cyan, magenta, yellow, red, blue, green, brown, or mixtures thereof.

23. A toner composition in accordance with claim 1 wherein the charge additive is a quaternary ammonium compound.

24. A toner composition in accordance with claim 1 wherein the charge additive functions to charge the toner positively, or the charge additive functions to charge the toner negatively, and which additive is present in an amount of from about 0.1 to about 10 weight percent based on the weight of the toner components.

25. A toner composition in accordance with claim 1 wherein the charge additive is an alkylpyridinium halide, distearyl dimethyl ammonium methylsulfate, or mixtures thereof.

26. A toner composition in accordance with claim 1 wherein there is present from about 70 to about 95 weight percent of resin.

27. A developer composition comprised of the toner composition of claim 1 and carrier particles.

28. A developer composition in accordance with claim 27 wherein the carrier particles are comprised of ferrites, steel, or an iron powder with an optional coating, or mixture of coatings.

29. A method of imaging which comprises formulating an electrostatic latent image on a negatively charged photoreceptor, affecting development thereof with the toner composition of claim 1, and thereafter transferring the developed image to a suitable substrate.

* * * * *